United States Patent [19]

Ikeda et al.

[11] 4,027,617

[45] June 7, 1977

[54] GRATING APPARATUS FOR PROTECTING THE DRAFT PORT OF A WATER-JET PROPULSION SYSTEM

[75] Inventors: Tsunemi Ikeda; Tamotsu Sezaki, both of Akashi, Japan

[73] Assignee: Kawasaki Jukogyo Kabushiki Kaisha, Kobe, Japan

[22] Filed: Mar. 16, 1976

[21] Appl. No.: 667,313

[30] Foreign Application Priority Data

Mar. 27, 1975 Japan ..... 50-42570[U]

[52] U.S. Cl. ..... 115/14; 114/221 R

[51] Int. Cl.[2] ..... B63H 11/04

[58] Field of Search ..... 115/.5 R, .5 HC, 11, 115/12 A, 14; 114/173, 174, 176, 177, 178, 182, 197, 198, 221 R; 244/53 B; 49/171, 394

[56] References Cited

UNITED STATES PATENTS

| | | | |
|---|---|---|---|
| 1,670,948 | 5/1928 | Ackerman | 49/171 |
| 1,763,464 | 6/1930 | Gunderson et al. | 114/173 |
| 3,111,108 | 11/1963 | Trotter | 115/14 |
| 3,706,164 | 12/1972 | Glause et al. | 49/394 |

*Primary Examiner*—Trygve M. Blix
*Assistant Examiner*—Charles E. Frankfort
*Attorney, Agent, or Firm*—Sughrue, Rothwell, Mion, Zinn & Macpeak

[57] ABSTRACT

A device for protecting the inlet or draft port of a water-jet propulsion system is disclosed. In a forward part of the inlet port of a drafting duct of a propulsion pump, a grate is mounted rotatable around a shaft which in turn is supported by a bracket. The bracket is secured to a lower part of the pump casing. A pin, passing through the grate, is urged by a spring to engage a part of the bracket to lock the grate in a position to block large objects from entering the duct. When the pin is disengaged against the force of the spring the grate is rotated to a position to permit manual entry into the duct for repair purposes.

5 Claims, 2 Drawing Figures

GRATING APPARATUS FOR PROTECTING THE DRAFT PORT OF A WATER-JET PROPULSION SYSTEM

BACKGROUND OF THE INVENTION

In small boats with water-jet propulsion apparatus, there is a possibility of injury to the hands of crew members or swimmers caused by the impeller or shaft of the propulsion apparatus when the hands are by any chance inserted into the drafting port of the apparatus. Furthermore, there is the possibility that dust or seaweed will intrude into the duct of the same apparatus. In order to prevent these disadvantageous features, it is necessary to provide a protecting device at the entrance of the drafting duct.

Heretofore, a grate has been provided at the entrance of the drafting duct as a protecting device. However, dust or other small items, such as rope or seaweed, frequently passes through the grate and is wound around the impeller shaft and the like regardless of the provision of the protecting device thereby impairing the efficiency of the propulsion system. When this occurs, the protecting device must be temporarily removed to permit cleaning of the impeller shaft. Normally, considerble manpower and time is required to remove and replace the protecting device.

SUMMARY OF THE INVENTION

The present invention is directed to a protecting device which is easily removed and reinstalled and which eliminates the above described disadvantages.

According to the invention, a grate is mounted at a forward part of the inlet port of a drafting duct in a manner freely rotatable around a shaft which is in turn supported by a bracket. The bracket is secured to a lower part of the pump casing. A pin passing through the grate is urged by a spring to engage a part of the bracket thereby to keep the grate in its operative position, and when the pin is disengaged against the force of the spring from the bracket, the grate is rotated to its inoperative position.

DETAILED DESCRIPTION OF THE INVENTION

Figure 1:
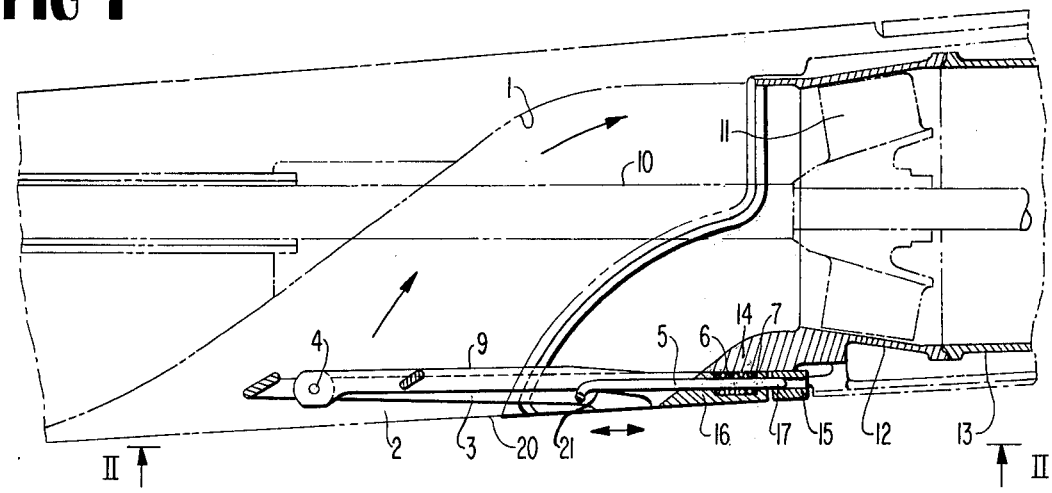
FIG. 1 is a fragmentary side view, partly in cross section, of a preferred embodiment of the invention.

Referring to FIG. 1 which is a fragmentary side view partly in cross section, the forward end of a drafting duct 1 of a propulsion pump opens at an entrance port 2 downwardly of the boat's hull, and the rear end of the same duct 1 (the right end in FIG. 1) opens rearwardly at the stern of the boat. Reference numeral 10 designates a main shaft, and numeral 11 designates an impeller fixed to the main shaft 10. The forward end of the main shaft 10 is coupled to an engine, and when the main shaft 10 is driven by the engine, water at the entrance port 2 is caused to flow in the direction indicated by the arrows through the interior of the drafting duct 1 and is pressurized by the impeller 11 to be ejected rearwardly, thereby to propel the boat in a forward direction.

Figure 2:
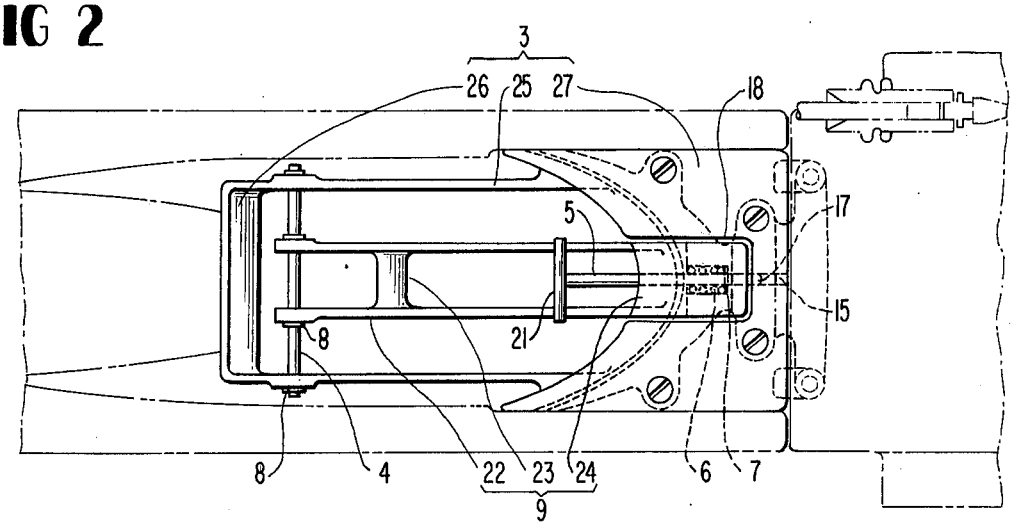
FIG. 2 is a bottom view taken along the line II—II in FIG. 1.

The pump casing 12 surrounding the impeller 11 constitutes a member forming one part of the wall of the duct 1, and is secured by bolts to the boat hull together with a guide vane 13. Likewise, the bracket 3 is secured by machine screws to a seat 14 formed at a lower part of the hull. A shaft 4 is received in holes formed at the forward parts of rods 25 formed integrally with the bracket 3, and a grate 9 is mounted to freely rotate on the shaft 4. The grate 9 is positioned by snap rings 8 (FIG. 2) along the shaft 4. A rectangular cutout 18 is provided in the bracket 3 to receive the grate 9. A pin 5 is passed through two holes formed through respective bosses 16 which are combined integrally with the grate 9. A rounded tip 17 of the pin 5 is inserted in an engaging manner in a hole provided in another boss 15 integral with the bracket 3. Numeral 7 designates a snap ring inserted in an annular groove provided around the pin 5. A coil spring 6 is extended in compressed manner between the snap ring 7 and a forward part of the boss 16, so that the pin 5 is normally urged by the coil spring 6 to be maintained in engagement with the hole in the boss 15 integral with the bracket 3. The space between the two bosses 16, the length of the coil spring 6, and the size of the head portion 17 of pin 5 are selected so that when the pin 5 is shifted forward the head portion 17 is entirely within the rear hole of the rear boss 16 and is not released therefrom; i.e., entirely removed from the hole in the boss 15 integral with the bracket 3. The grate 9 is positioned inwardly of the keel line 20 of the boat thereby to prevent the lower surface of the grate 9, inserted in the cutout 18, from being projected downwardly below the bottom of the boat. Also the length of handle 21 of the pin 5 is selected to be greater than the width of the grate 9 so that the rotation around the axis of the pin is prevented, and thus any possibility of the handle 21 projecting downwardly from the bottom of the boat is eliminated.

The bracket 3 comprises two rods 25, a rib 26 connecting forward ends of the two rods 25, and a planar flange 27 connecting rear ends of the same rods 25. The distance between the two rods 25 is selected to be sufficiently wide, so that an arm can be inserted therethrough for cleaning the shaft and the impeller. The grate 9 also comprises two rods 22, a forward rib 23 and a rearward planar flange 24 connecting the two rods 22.

When it is desired to displace the grate 9 for opening the inlet port 2, the handle 21 is pulled by hand against the force of the spring 6 to its forward extremity (toward the left in the drawing) so that the head portion 17 of the pin 5 is disengaged from the hole of the boss 15 of the bracket 3. Thus, the grate 9 is swung down by its own weight around the shaft 4, and the entrance port 2 of the drafting duct is thereby opened. The grate 9 can be thereafter returned to its original position by turning it around the shaft 4 in the counterclockwise direction, pulling the handle 21 to the forward extremity, and then releasing the handle 21 thereby to insert the head portion 17 of the pin 5 into the hole in the boss 15 of the bracket 3.

Some of the advantageous features of the present invention are as follows.

Since the grate 9 can be displaced from the closing position to the opening position by a single step, the opening and closing procedure is much simpler as compared with the conventional fixed type protecting device.

During cruising, water along the hull acts on the handle 21 of the pin 5 in a manner pushing the handle 21 rearwardly, whereby there is no possibility of the head portion 17 of the pin 5 being disengaged out of the hole in the boss 15 of the bracket 3.

What is claimed is:

1. Apparatus for protecting the inlet water port of a water-jet propulsion apparatus, comprising, a fixed bracket positioned at the mouth of said inlet port and having an opening therein sufficiently large to permit manual access therethrough, a grate rotatably attached to said bracket to permit said grate to be rotated to first and second positions to prevent manual access through said bracket and to permit manual access through said bracket respectively, and a pin spring biased to connect said grate to said bracket to hold said grate in said first position, whereby said spring biasing can be manually overcome to disconnect said grate from said bracket said pin being spring biased in the direction of flow of water in said water-jet propulsion system, whereby the force of water pushing against said pin during normal operation will not oppose the spring biasing force.

2. Apparatus as claimed in claim 1 wherein said water jet-propulsion apparatus has a hull and wherein said bracket comprises two parallel rods connected at one end by a bracket plate fixed to said hull, and a crossing rod connected between said two parallel rods near an end thereof opposite said plate, said grate being rotatably mounted on said crossing rod.

3. Apparatus as claimed in claim 2 wherein said grate comprises, first and second parallel rods rotatably attached to said crossing rod of said bracket at one end of said grate, and a grate plate attached to said parallel rods at the opposite end of said grate, said grate plate having a first slot therethrough parallel to said parallel rods for receiving said pin, and wherein said bracket plate has a second slot therein for receiving the end of said pin when said grate is in said first position.

4. Apparatus as claimed in claim 3 wherein said pin has a tee shape, the longer portion of said pin being positioned to pass through said first slot in said grate plate and into said second slot in said bracket plate, and the crossing portion of said tee shaped pin attached to the longer portion at the end opposite that which passes into said first and second slots and being longer than the distance between parallel rods of said grate, whereby said crossing portion of said pin in conjunction with said parallel rods of said grate prevents said pin from rotating.

5. Apparatus as claimed in claim 4 further comprising, a spring means connected to said pin in said first slot in such a manner to bias said pin in the direction toward said first and second slots, whereby said crossing portion of said pin serves as a manual handle that can be pulled to overcome said spring bias and remove said pin from said second slot.

* * * * *